US008753081B2

(12) United States Patent
Aynsley et al.

(10) Patent No.: US 8,753,081 B2
(45) Date of Patent: Jun. 17, 2014

(54) AIR FENCE FOR FAN BLADE

(75) Inventors: Richard M. Aynsley, Doonan (AU); Richard A. Oleson, Lexington, KY (US)

(73) Assignee: Delta T Corporation, Lexington, KY (US)

( * ) Notice: Subject to any disclaimer, the term of this patent is extended or adjusted under 35 U.S.C. 154(b) by 749 days.

(21) Appl. No.: 12/889,475

(22) Filed: Sep. 24, 2010

(65) Prior Publication Data

US 2011/0081246 A1 Apr. 7, 2011

Related U.S. Application Data

(60) Provisional application No. 61/248,158, filed on Oct. 2, 2009.

(51) Int. Cl.

| | |
|---|---|
| ***F04D 29/34*** | (2006.01) |
| ***F04D 19/00*** | (2006.01) |
| ***F04D 25/08*** | (2006.01) |
| ***F04D 29/32*** | (2006.01) |
| *F04D 29/38* | (2006.01) |

(52) U.S. Cl.

CPC ..... *F04D 19/002* (2013.01); *F04D 25/088* (2013.01); *F04D 29/326* (2013.01); *F04D 29/388* (2013.01)

USPC ..... 416/5; 416/62; 416/236 R

(58) Field of Classification Search

CPC ... F04D 19/002; F04D 25/088; F04D 29/326; F04D 29/388

USPC ..... 416/5, 62, 228, 236 R, 236 A, 237, 243

See application file for complete search history.

(56) References Cited

U.S. PATENT DOCUMENTS

| | | | | |
|---|---|---|---|---|
| 571,500 | A | 11/1896 | West | |
| 2,110,621 | A * | 3/1938 | Cohen | 416/236 A |
| 4,128,363 | A | 12/1978 | Fujikake et al. | |
| 4,265,596 | A * | 5/1981 | Katagiri et al. | 416/236 A |
| 4,396,351 | A * | 8/1983 | Hayashi et al. | 416/236 A |

(Continued)

FOREIGN PATENT DOCUMENTS

WO WO 2009/100052 8/2009

OTHER PUBLICATIONS

BAF Catalogue, Delta Corp. (Dec. 2008) http://www.bigassfans.com/pdf/BAFcatalog_v31003.pdf, retrieved on Nov. 18, 2010.

(Continued)

*Primary Examiner* — Igor Kershteyn

(74) *Attorney, Agent, or Firm* — King & Schickli, PLLC

(57) ABSTRACT

A fan comprises a rotatable hub, a plurality of fan blades coupled with the hub, and a plurality of air fences coupled with the fan blades. Each fan blade has a free end and an opposite end secured to the hub. The air fences are positioned at selected locations along the length of the fan blades, between the ends of the fan blades. Each air fence includes a fin, which may extend upwardly or downwardly from the fan blade. Each air fence may be formed of a resilient material and may be configured to allow the air fence to be snapped onto a fan blade. Each air fence may define an opening through which a fan blade may be inserted. One or more surfaces of the air fence may be contoured to complement a surface contour of an airfoil shaped fan blade.

22 Claims, 11 Drawing Sheets

(56) References Cited

U.S. PATENT DOCUMENTS

| | | | | |
|---|---|---|---|---|
| 4,693,673 | A | 9/1987 | Nee | |
| 5,193,983 | A * | 3/1993 | Shyu | 416/236 A |
| 5,217,349 | A * | 6/1993 | Succi | 415/119 |
| 5,988,978 | A | 11/1999 | Pearce | |
| 6,244,821 | B1 | 6/2001 | Boyd et al. | |
| 6,939,108 | B2 | 9/2005 | Boyd | |
| 7,108,480 | B2 | 9/2006 | Zatorski et al. | |
| 7,252,478 | B2 | 8/2007 | Aynsley | |
| 7,284,960 | B2 | 10/2007 | Aynsley | |
| D587,799 | S | 3/2009 | Oleson | |
| D607,988 | S | 1/2010 | Oleson et al. | |
| 2006/0018759 | A1 * | 1/2006 | Moser | 416/223 R |
| 2008/0008596 | A1 | 1/2008 | Aynsley | |
| 2008/0014090 | A1 | 1/2008 | Aynsley et al. | |
| 2008/0213097 | A1 | 9/2008 | Oleson | |
| 2009/0072108 | A1 | 3/2009 | Oleson | |
| 2009/0081045 | A1 | 3/2009 | Scherer et al. | |
| 2009/0097975 | A1 | 4/2009 | Aynsley et al. | |
| 2009/0162197 | A1 | 6/2009 | Klemo et al. | |
| 2009/0208333 | A1 | 8/2009 | Smith et al. | |
| 2010/0104461 | A1 | 4/2010 | Smith et al. | |

OTHER PUBLICATIONS

International Search Report and Written Opinion dated Dec. 6, 2010 for Application No. PCT/US10/50125.

U.S. Appl. No. 61/165,582, filed Apr. 1, 2009, Woolcott.

U.S. Appl. No. 61/369,953, filed Aug. 2, 2010, Fizer et al.

U.S. Appl. No. 12/773,094, filed May 4, 2010, Oleson et al.

* cited by examiner

AIR FENCE FOR FAN BLADE

PRIORITY

This application claims priority to U.S. Provisional Patent Application Ser. No. 61/248,158, filed Oct. 2, 2009, entitled "Air Fence for Fan Blade," the disclosure of which is incorporated by reference herein.

BACKGROUND

A variety of fan systems have been made and used over the years in a variety of contexts. For instance, various ceiling fans are disclosed in U.S. Pat. No. 7,284,960, entitled "Fan Blades," issued Oct. 23, 2007; U.S. Pat. No. 6,244,821, entitled "Low Speed Cooling Fan," issued Jun. 12, 2001; U.S. Pat. No. 6,939,108, entitled "Cooling Fan with Reinforced Blade," issued Sep. 6, 2005; and U.S. Pat. No. D607,988, entitled "Ceiling Fan," issued Jan. 12, 2010. The disclosures of each of those U.S. patents are incorporated by reference herein. Additional exemplary fans are disclosed in U.S. Pub. No. 2008/0008596, entitled "Fan Blades," published Jan. 10, 2008; U.S. Pub. No. 2009/0208333, entitled "Ceiling Fan System with Brushless Motor," published Aug. 20, 2009; and U.S. patent application Ser. No. 12/773,094, entitled "Ceiling Fan with Variable Blade Pitch and Variable Speed Control," filed May 4, 2010, the disclosures of which are also incorporated by reference herein. It should be understood that teachings herein may be incorporated into any of the fans described in any of the above-referenced patents, publications, or patent applications.

A fan blade may be formed of several components that permit its configuration to be changed in a modular fashion. Examples of modular fan blades are disclosed in U.S. Pub. No. 2010/0104461, entitled "Multi-Part Modular Airfoil Section and Method of Attachment between Parts," published Apr. 29, 2010, the disclosure of which is incorporated by reference herein. A fan blade or airfoil may also include additional reinforcement relative to the hub of the fan. Merely exemplary fan blade reinforcement components and configurations are described in U.S. Provisional Patent App. No. 61/369,953, entitled "Fan Blade Retention System," filed Aug. 2, 2010, the disclosure of which is incorporated by reference herein. Alternatively, any other suitable type of component or feature may be used to reinforce the coupling of a fan blade with a fan hub; or such components or features may simply be omitted.

The outer tip of a fan blade or airfoil may be finished by the addition of an aerodynamic tip or winglet. Merely exemplary winglets are described in U.S. Pat. No. 7,252,478, entitled "Fan Blade Modifications," issued Aug. 7, 2007, the disclosure of which is incorporated by reference herein. Additional winglets are described in U.S. Pub. No. 2008/0014090, entitled "Cuffed Fan Blade Modifications," published Jan. 17, 2008, filed Sep. 25, 2007, the disclosure of which is incorporated by reference herein. Still other exemplary winglets are described in U.S. Design Pat. No. D587,799, entitled "Winglet for a Fan Blade," issued Mar. 3, 2009, the disclosure of which is incorporated by reference herein. In some settings, such winglets may interrupt the outward flow of air at the tip of a fan blade, redirecting the flow to cause the air to pass over the fan blade in a perpendicular direction, and also ensuring that the entire air stream exits over the trailing edge of the fan blade and reducing tip vortex formation. In some settings, this may result in increased efficiency in operation in the region of the tip of the fan blade. In other variations, an angled extension may be added to a fan blade or airfoil, such as the angled airfoil extensions described in U.S. Pub. No. 2008/0213097, entitled "Angled Airfoil Extension for Fan Blade," published Sep. 4, 2008, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed (e.g., with a cap or otherwise, etc.), or may lack any similar structure at all.

The interface of a fan blade and a fan hub may also be provided in a variety of ways. For instance, an interface component is described in U.S. Pub. No. 2009/0081045, entitled "Aerodynamic Interface Component for Fan Blade," published Mar. 26, 2009, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Pub. No. 2009/0072108, entitled "Ceiling Fan with Angled Mounting," published Mar. 19, 2009, the disclosure of which is incorporated herein. Of course, a fan need not be mounted to a ceiling or other overhead structure, and instead may be mounted to a wall or to the ground. For instance, a fan may be supported on the top of a post that extends upwardly from the ground. Alternatively, any other suitable mounting structures and/or mounting techniques may be used in conjunction with embodiments described herein.

It should also be understood that a fan may include sensors or other features that are used to control, at least in part, operation of a fan system. For instance, such fan systems are disclosed in U.S. Pub. No. 2009/0097975, entitled "Ceiling Fan with Concentric Stationary Tube and Power-Down Features," published Apr. 16, 2009, the disclosure of which is incorporated by reference herein; U.S. Pub. No. 2009/0162197,entitled "Automatic Control System and Method to Minimize Oscillation in Ceiling Fans," published Jun. 25, 2009, the disclosure of which is incorporated by reference herein; WIPO Pub. No. WO/2009/100052, entitled "Automatic Control System for Ceiling Fan Based on Temperature Differentials," published Aug. 13, 2009, the disclosure of which is incorporated by reference herein; and U.S. Provisional Patent App. No. 61/165,582, entitled "Fan with Impact Avoidance System Using Infrared," filed Apr. 1, 2009, the disclosure of which is incorporated by reference herein. Alternatively, any other suitable control systems/features may be used in conjunction with embodiments described herein.

In some settings, it may be desirable to replicate or approximate the function of a winglet in a component that may be located at a position on a fan blade other than at the free end of the fan blade. Such a component may provide an effect on fan efficiency similar to the effect provided by a winglet, albeit at one or more additional regions of the fan blade. In particular, such a component or accessory may serve as an aerodynamic guide or air fence, interrupting slippage of air along the length or longitudinal axis of the fan blade; and redirecting the air flow to a direction perpendicular to the longitudinal axis of the fan blade, above and/or below the fan blade.

While a variety of components have been included with fans and fan systems, it is believed that no one prior to the inventors has made or used the invention described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
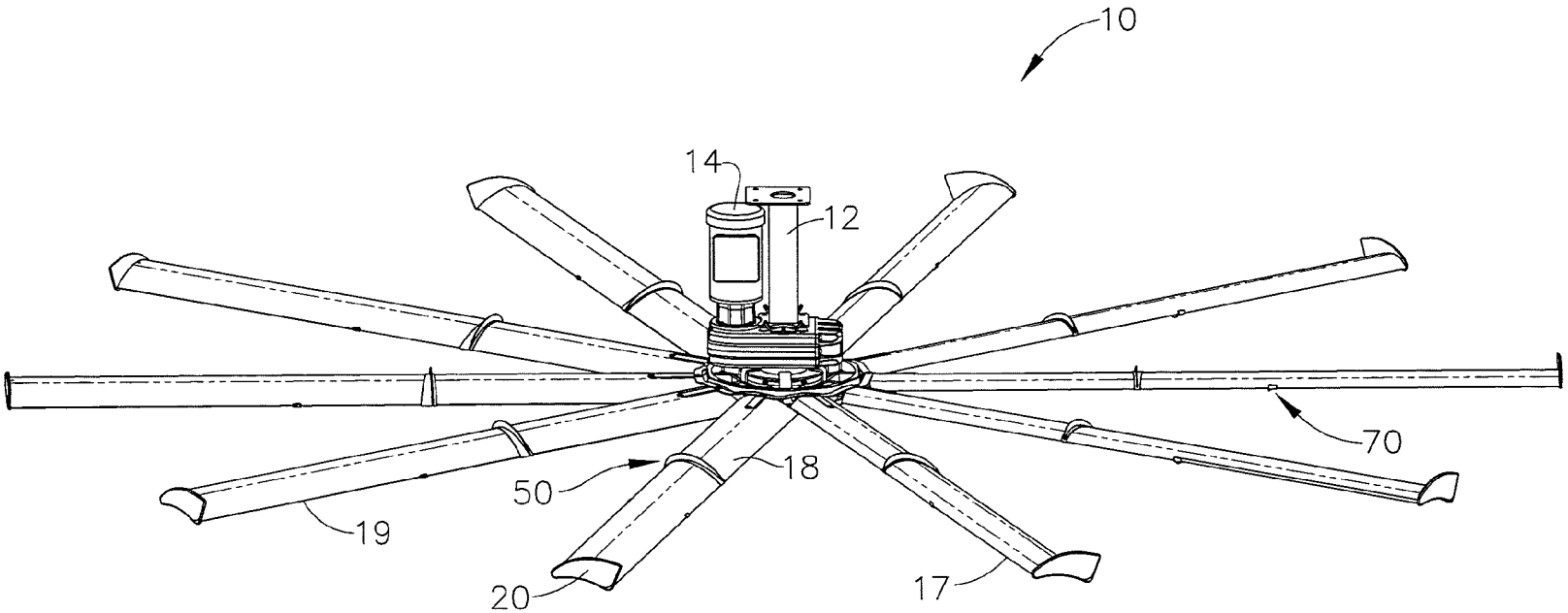
FIG. 1 depicts an upper perspective view of a fan with exemplary air fences on its fan blades.
Figure 2:
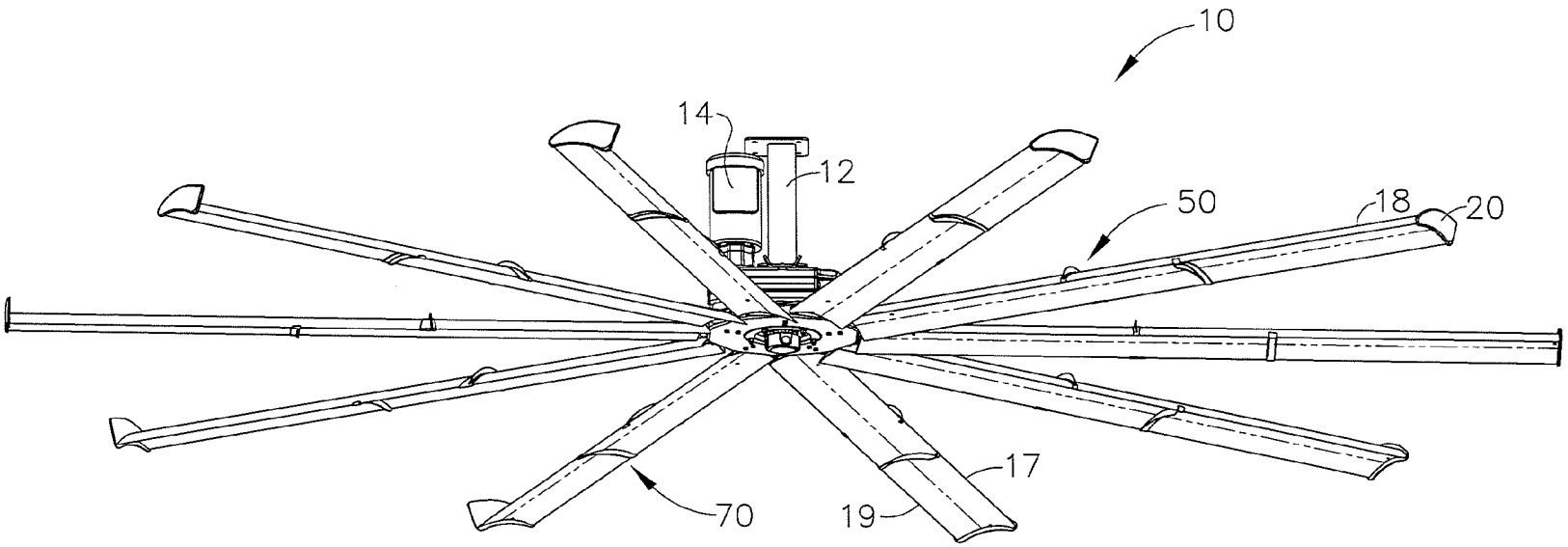
FIG. 2 depicts a lower perspective view of the fan of FIG. 1.
Figure 3:
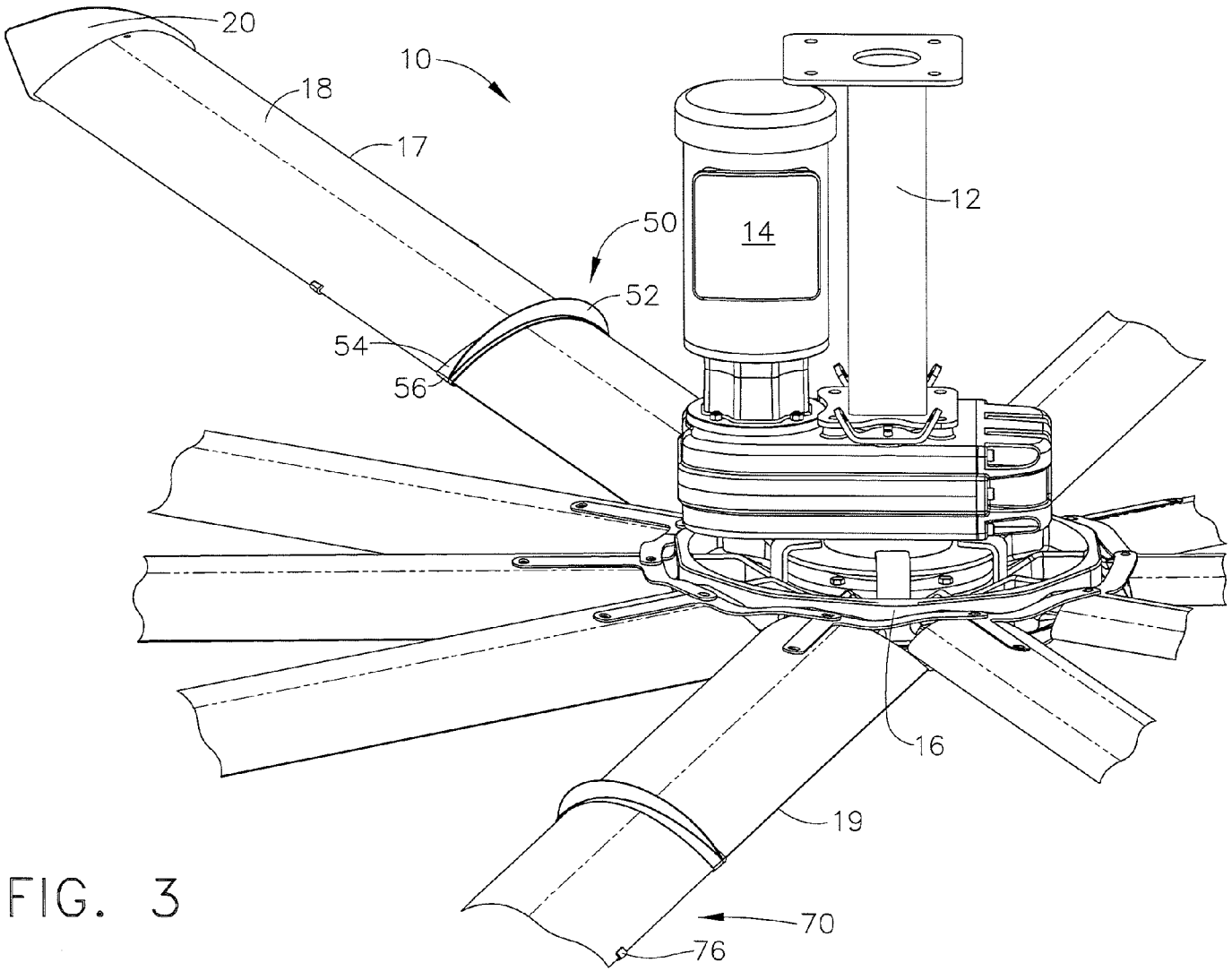
FIG. 3 depicts an upper partial perspective view of the fan of FIG. 1.
Figure 4:
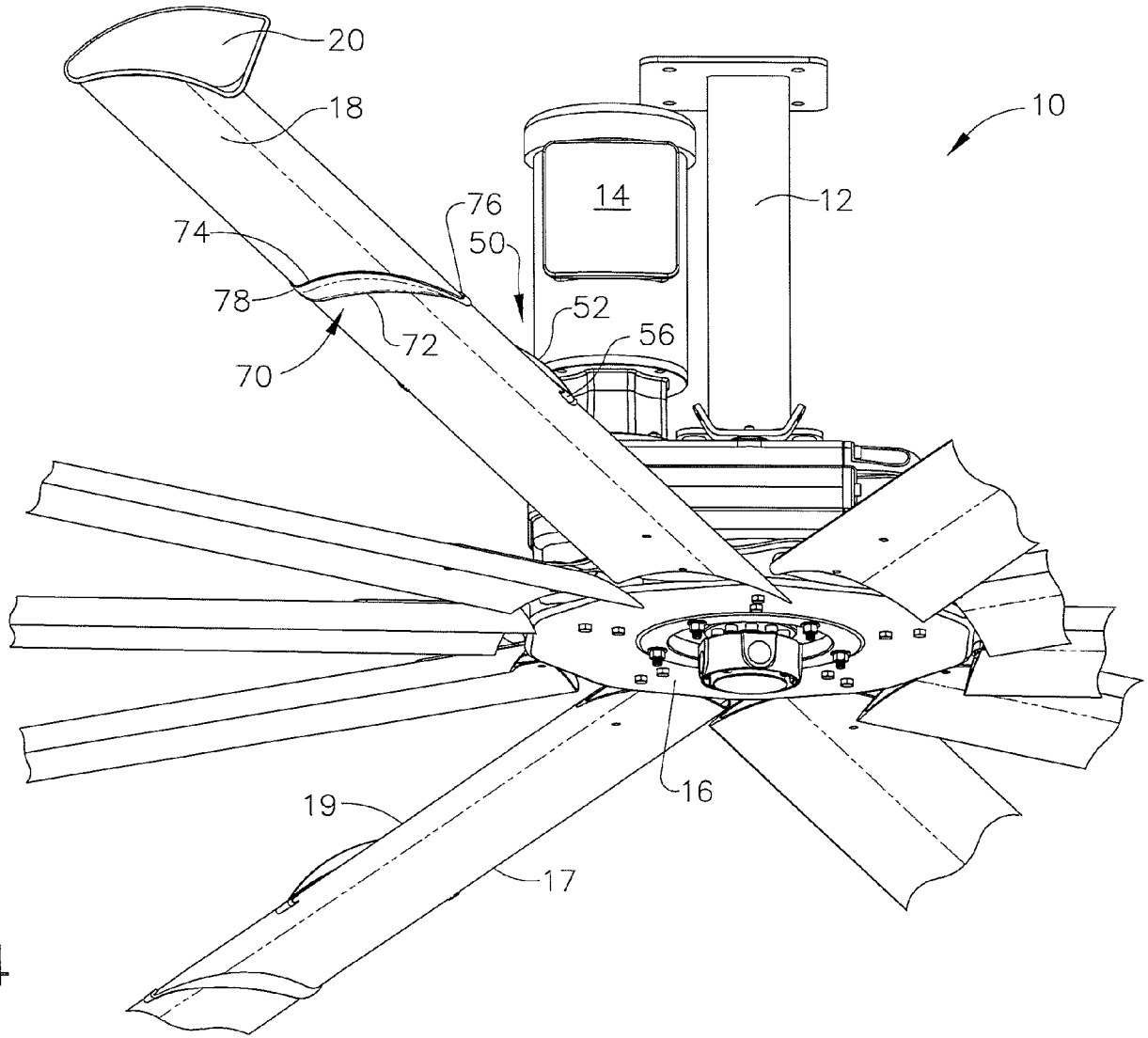
FIG. 4 depicts a lower partial perspective view of the fan of FIG. 1.
Figure 5:
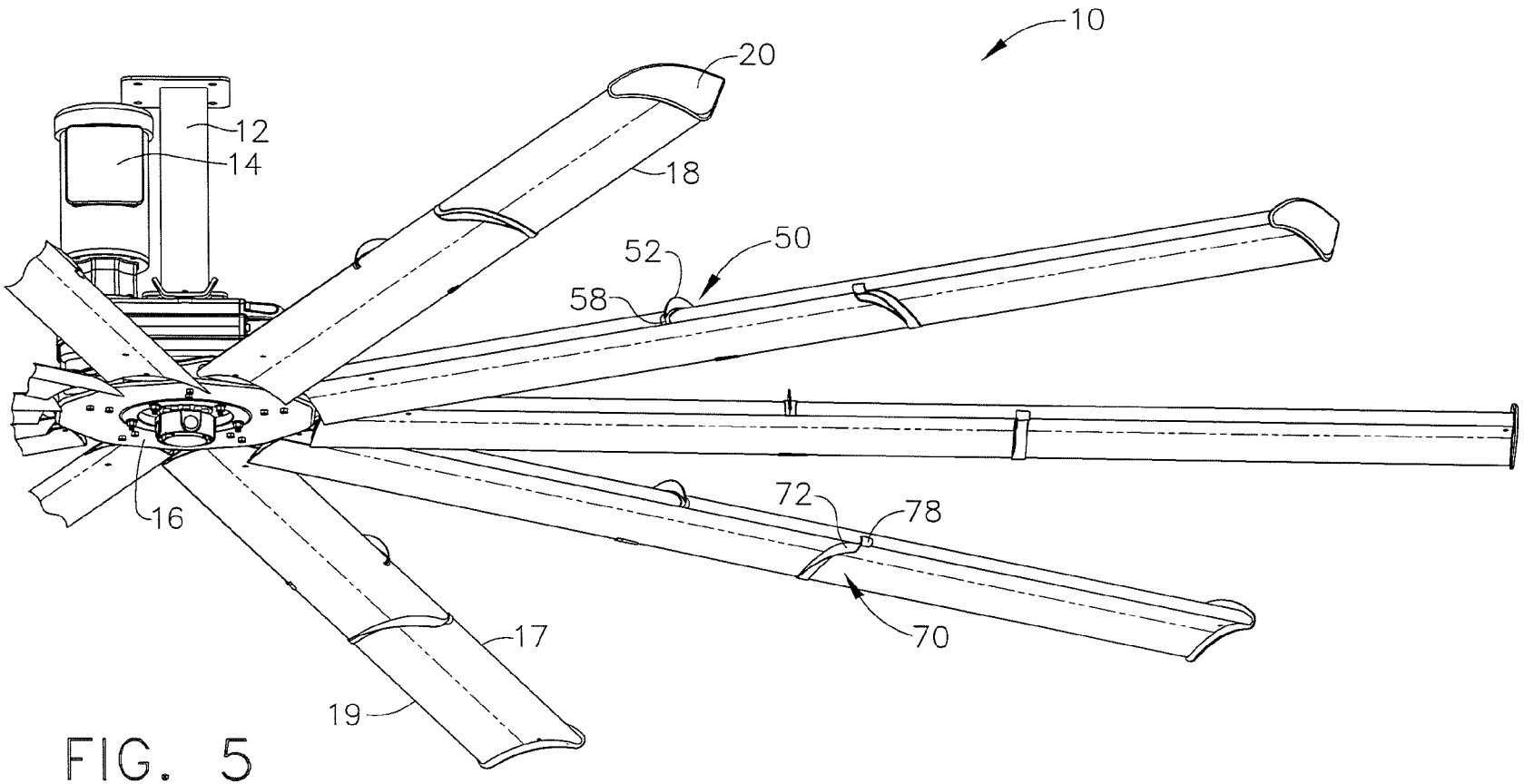
FIG. 5 depicts another lower partial perspective view of the fan of FIG. 1.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

As shown in FIGS. 1-5, an exemplary fan (10) includes a support (12), a motor (14), a hub (16), and a plurality of fan blades (18). Support (12) is configured to be coupled with a ceiling structure, such that fan (10) may be suspended from a ceiling. Support (12) may be constructed and/or operable in accordance with the teachings of any of the patents, patent publications, or patent applications cited herein. Fan blades (18) extend radially outwardly from hub (16), and motor (14) is operable to rotate hub (16) with fan blades (18). A winglet (20) is coupled with the free end of each fan blade (18). Any of these components, among other components that fan (10) may have as desired, may be constructed and/or operable in accordance with the teachings of any of the patents, patent publications, or patent applications cited herein. Indeed, various ways in which the teachings of the patents, patent publications, or patent applications cited herein may be combined with the teachings of the present application will be apparent to those of ordinary skill in the art. By way of example only, hub (16) and fan blades (18) may be configured such that fan (10) has a diameter of approximately 8 feet. In other variations, fan (10) has a diameter between approximately 6 feet, inclusive, and approximately 24 feet, inclusive. Alternatively, fan (10) may have any other suitable dimensions.

As is shown in FIGS. 1-10, each fan blade (18) includes an upper air fence (50) and a lower air fence (70) secured thereto. While each fan blade (18) is shown as only including one upper air fence (50) and one lower air fence (70), it should be understood that each fan blade (18) may have any desired number of air fences (50, 70). For instance, each fan blade (18) may have only one or more upper air fences (50) or only one or more lower air fences (70). It should also be understood that, while air fences (50, 70) are each shown as being positioned at a location corresponding to approximately ⅔ the length of each fan blade (18) relative to hub (16), air fences (50, 70) may be located at any other suitable position(s) along the length of each fan blade (18). Similarly, while upper air fence (50) and lower air fence (70) are shown as being positioned at substantially proximate locations along the length of fan blade (18), it should be understood that upper air fence (50) and lower air fence (70) may be positioned in any other suitable relationship relative to each other.

Each upper air fence (50) of the present example comprises a vertical fin (52) and a base (54). Base (54) is configured to permit upper air fence (50) to be removably secured to the upper surface of a fan blade (18). In the present example, vertical fin (52) and base (54) are formed unitarily together as a single piece of resilient plastic material. For instance, fin (52) and base (54) may be molded together. Alternatively, fin (52) and base (54) may be formed separately then later joined together using any suitable devices or techniques. Similarly, fin (52) and base (54) may be formed of any desirable material or combinations of materials (e.g., plastic base (54) with metal fin (52), etc.), and may have any desired properties in addition to or in lieu of having resilient properties.

Figure 11:
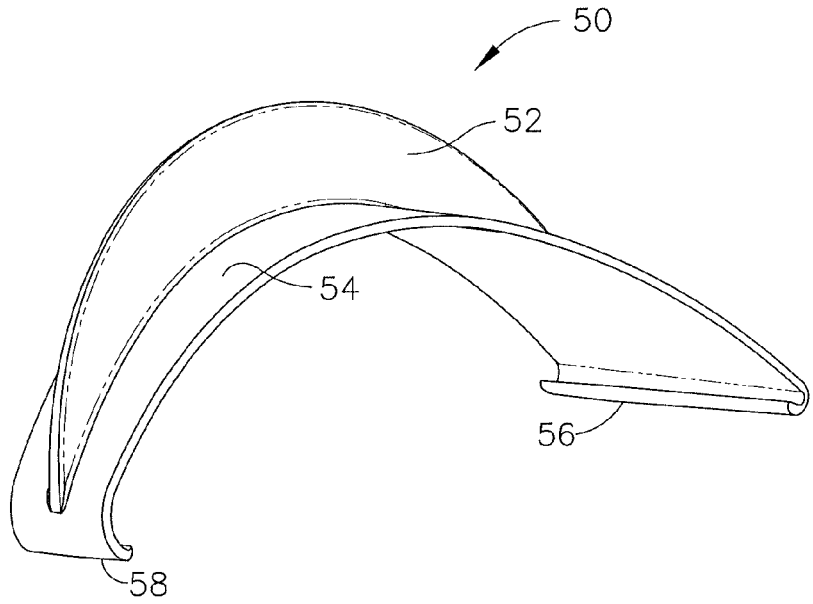
FIG. 11 depicts a perspective view of an upper air fence of the fan of FIG. 1.
Figure 12:
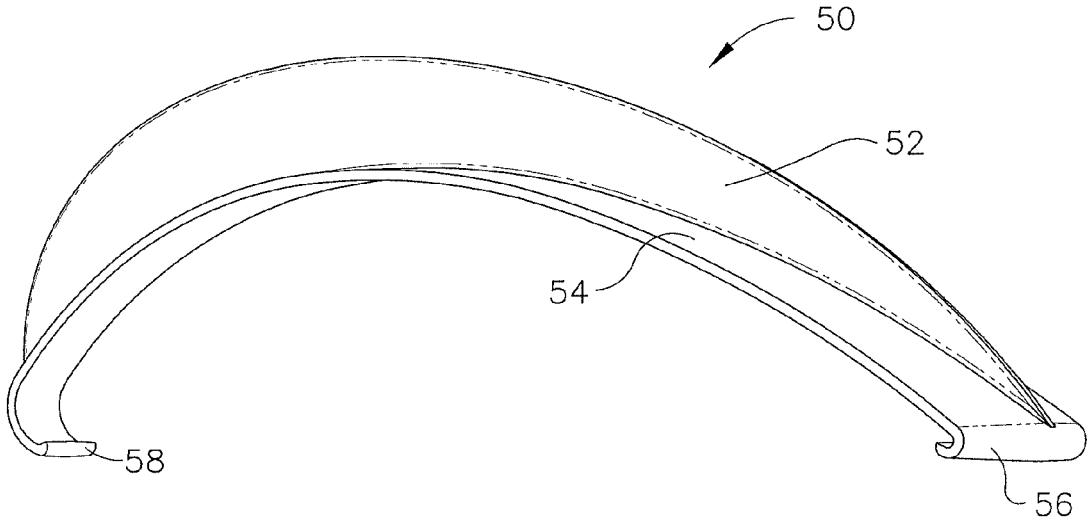
FIG. 12 depicts another perspective view of an upper air fence of the fan of FIG. 1.

In the present example, the resilience of upper air fence (50) permits it to be snapped on over fan blade (18). In particular, the resilience of the material permits base (54) to deform to pass over the edge of fan blade (18) and then return to its original shape to lock it into place. As best shown in FIGS. 11-12, base (54) has clip ends (56, 58), which provide a snug fit against the trailing and leading edges (19, 17) of fan blade (18). In one merely exemplary method of securing upper air fence (50) to fan blade, trailing edge clip end (56) is first engaged with trailing edge (19) of fan blade (18). Upper air fence (50) is then rotated toward leading edge (17) of fan blade (18) until leading edge clip end (58) deforms away from leading edge (17) to clear leading edge (17) of fan blade (18). Upon clearing leading edge (17) of fan blade (18), leading edge clip end (58) snaps back to securely grip leading edge (17) of fan blade (18). The resilience of upper air fence (50)

and the relative, complementary cross-sections of upper air fence (50) and fan blade (18) may substantially prevent upper air fence (50) from sliding along the length of fan blade (18) during operation of fan (10). That is, the resilient bias of upper air fence (50) may increase friction between upper air fence (50) and fan blade (18) once upper air fence (50) has been installed on fan blade (18). In lieu of or in addition to such a "snap" fitting, upper air fence (50) may be secured to fan blade (18) using adhesive, mechanical fasteners, and/or any other suitable components, devices, or techniques.

In another version, each upper air fence (50) is substantially rigid, and base (54) is slid onto an end of fan blade (18). For instance, upper air fence (50) may be slid onto the hub end of fan blade (18) before fan blade (18) is coupled with hub (16). Alternatively, upper air fence (50) may be slid onto the free end of fan blade (18) before a winglet (20) is secured to the free end of fan blade (18). Regardless of whether upper air fence (50) is rigid or resilient, in some versions, removal of upper air fence (50) may be accomplished by sliding upper air fence (50) off either end of fan blade (18). A resilient upper air fence (50) may alternatively be "un-snapped" from fan blade (18) in some settings, such as by prying or peeling leading edge clip end (58) from leading edge (17) of fan blade (18) or in any other suitable fashion.

In the present example, the upper interior surface of base (54) has a profile that approximates the corresponding profile of fan blade (18), such that the base (54) is substantially continuously engaged with fan blade (18) across the transverse width of fan blade (18). Furthermore, vertical fin (52) has a profile that complements the profile of fan blade (18). It should be understood, however, that base (54) and fin (52) may each have any other desired profile. Such alternative profiles may have any suitable relationship with, or no relationship at all with, each other and/or the profile of fan blade (18). For instance, in the present example, fin (52) is configured such that its vertical height from base (54) is greater near leading edge clip end (58) than the vertical height of fin (52) from base (54) near trailing edge clip end (56). That is, fin (52) tapers down toward trailing edge (19) of fan blade (18). In some other versions, fin (52) is configured such that its vertical height from base (54) is greater near trailing edge clip end (56) than the vertical height of fin (52) from base (54) near leading edge clip end (58). In some such versions, fin (52) may taper down toward leading edge (17) of fan blade (18). Still other suitable configurations for fin (52) will be apparent to those of ordinary skill in the art in view of the teachings herein.

As shown, base (54) terminates at clip ends (56, 58), such that a gap is defined between clip ends (56, 58). In other versions, clip ends (56, 58) are omitted, and base (54) continuously defines an opening or aperture for a fan blade (18) to be slid into. Such an opening may have a cross-section that complements the cross-section of fan blade (18) or any other suitable cross-section. An example of such a configuration is described in greater detail below with reference to FIGS. 15-17.

Figure 6:
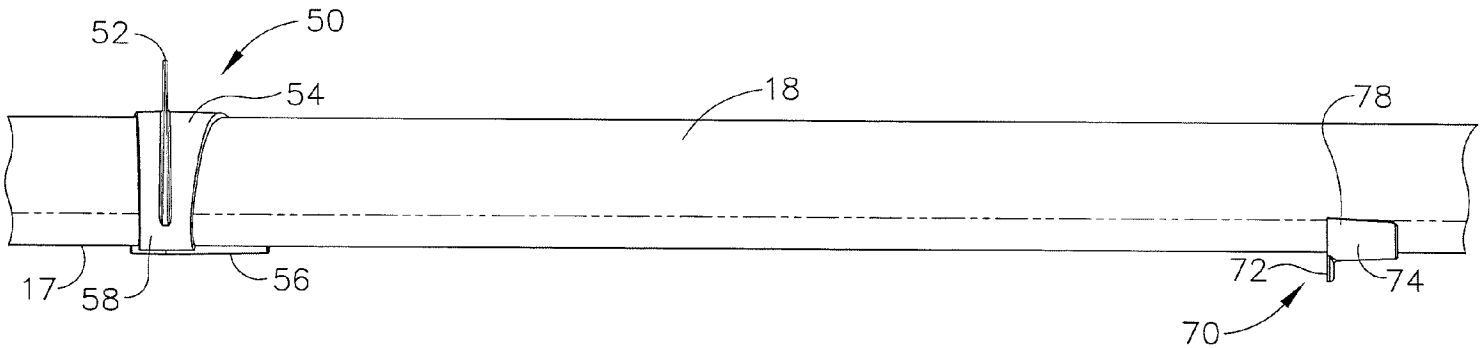
FIG. 6 depicts a front plan view of a fan blade with the air fences of the fan of FIG. 1.
Figure 7:
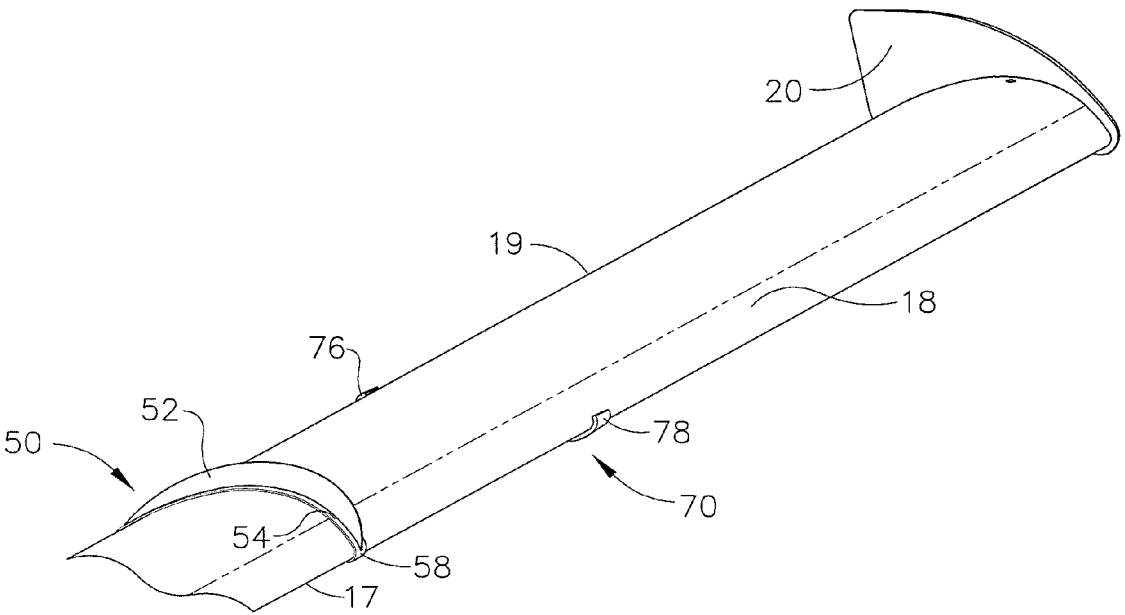
FIG. 7 depicts an upper perspective view of the fan blade of FIG. 6.
Figure 8:
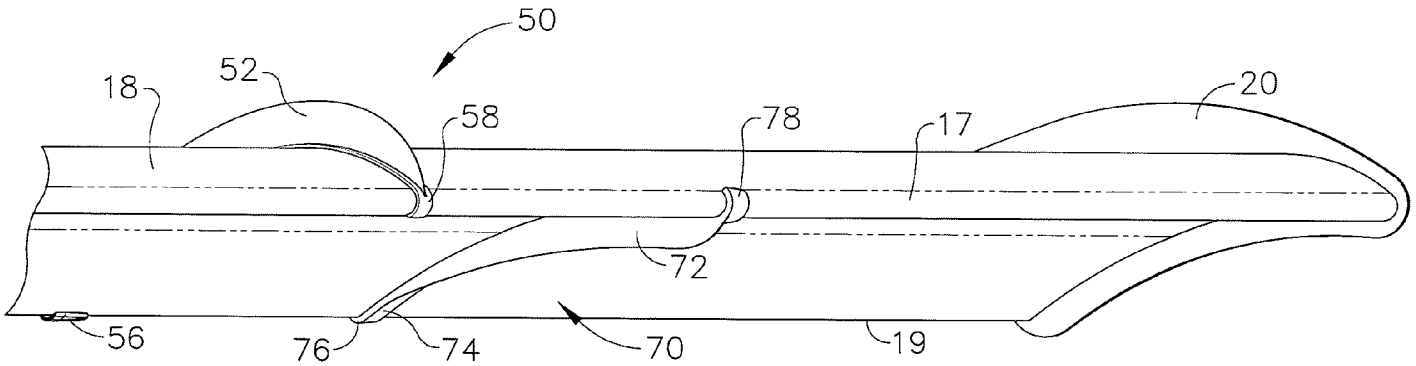
FIG. 8 depicts a lower perspective view of the fan blade of FIG. 7.
Figure 9:
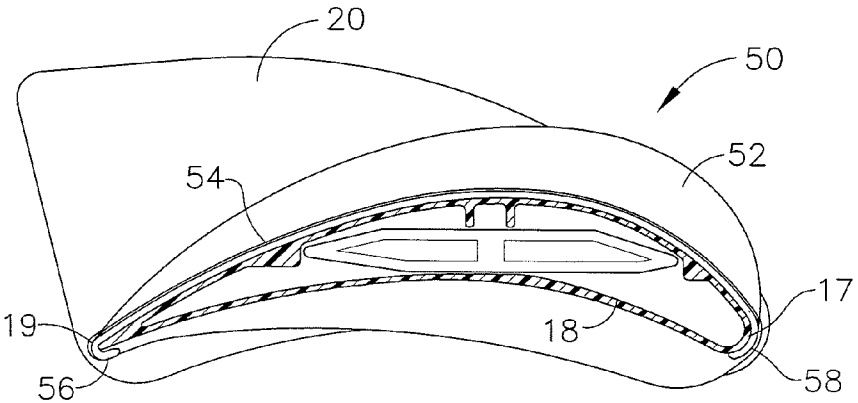
FIG. 9 depicts a cross-sectional view of the fan blade of FIG. 6, viewed from the hub end of the fan blade toward the free end of the fan.
Figure 10:
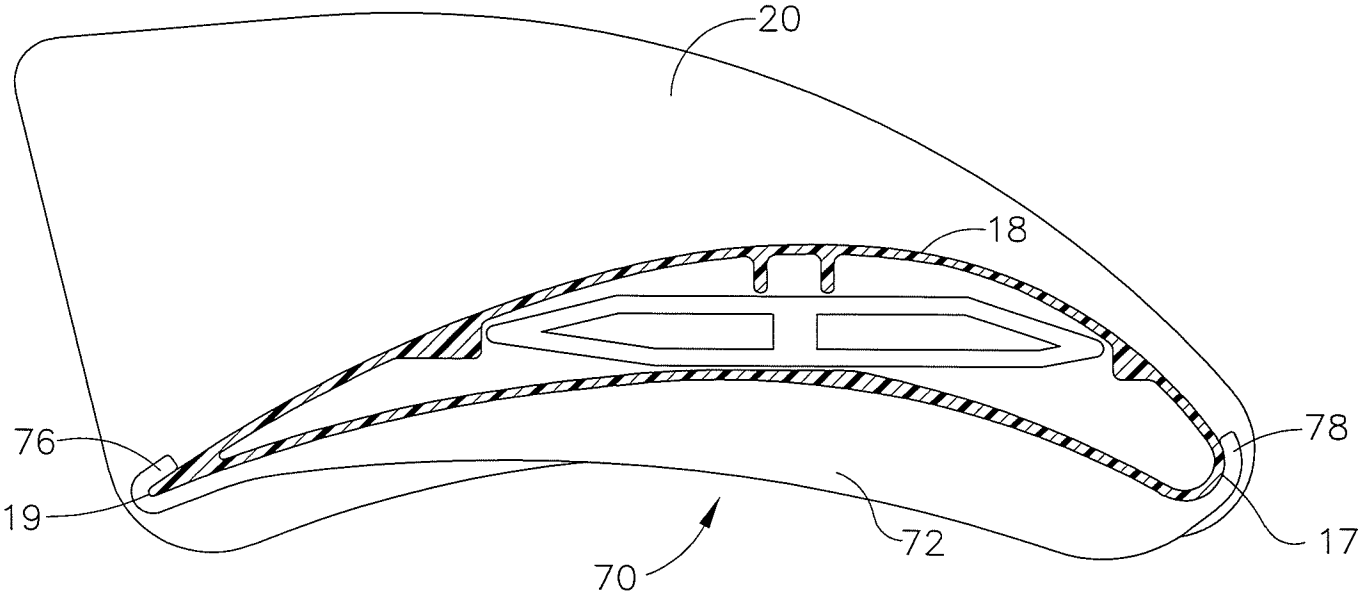
FIG. 10 depicts a cross-sectional view of the fan blade of FIG. 6, viewed from the hub end of the fan blade toward the free end of the fan blade, and with the upper air fence omitted.

As shown in FIGS. 6 and 11-12, leading edge clip end (58) is narrower than trailing edge clip end (56). That is, trailing edge clip end (56) extends along a greater length of fan blade (18) than the length of fan blade (18) that leading edge clip end (58) extends along. It should be understood, however, that clip ends (56, 58) may alternatively have approximately the same width. Alternatively, leading edge clip end (58) may be wider than trailing edge clip end (56).

As also shown, fin (52) is positioned between outer lateral edges of base (54). In some other versions, fin (52) is positioned at an outer lateral edge of base (54). For instance, upper air fence (50) may be configured such that fin (52) is positioned closer to hub (16), with base (54) extending toward winglet (20), when upper air fence (50) is installed on fan blade (18). Alternatively, fin (52) may be positioned such that it is positioned closer to winglet (20) when upper air fence (50) is installed on fan blade (18), with base (54) extending toward hub (16). As yet another merely exemplary variation, fin (52) may extend at an angle. For instance, fin (52) may be angled such that it is closer to hub (16) near leading edge (17) yet closer to winglet (20) near trailing edge (19); or vice versa. Similarly, while fin (52) defines a substantially right angle with base (54) in the present example, it should be understood that fin (52) may alternatively define an acute or obtuse angle with base (54). Still other suitable ways in which fin (52) may be positioned and/or oriented will be apparent to those of ordinary skill in the art in view of the teachings herein.

Each lower air fence (70) of the present example comprises a vertical fin (72) and a base (74). Base (74) is configured to permit lower air fence (70) to be removably secured to the lower surface of a fan blade (18). In the present example, vertical fin (72) and base (74) are formed unitarily together as a single piece of resilient plastic material. For instance, fin (72) and base (74) may be molded together. Alternatively, fin (72) and base (74) may be formed separately then later joined together using any suitable devices or techniques. Similarly, fin (72) and base (74) may be formed of any desirable material or combinations of materials (e.g., plastic base (74) with metal fin (72), etc.), and may have any desired properties in addition to or in lieu of having resilient properties.

Figure 13:
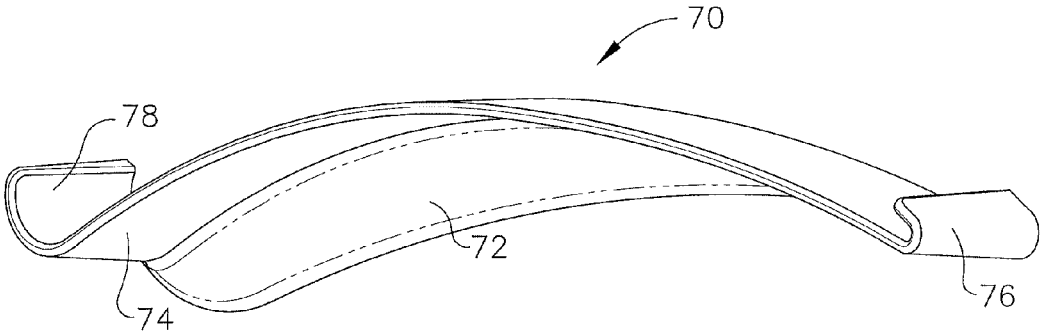
FIG. 13 depicts a perspective view of a lower air fence of the fan of FIG. 1.
Figure 14:
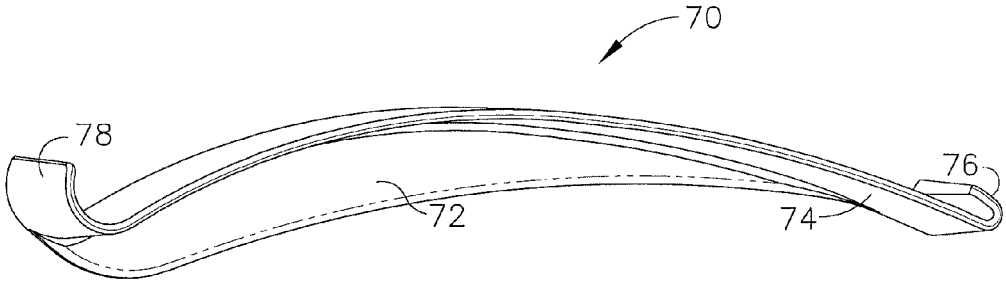
FIG. 14 depicts another perspective view of a lower air fence of the fan of FIG. 1.

In the present example, the resilience of lower air fence (70) permits it to be snapped on over fan blade (18). In particular, the resilience of the material permits base (74) to deform to pass over the edge of fan blade (18) and then return to its original shape to lock it into place. As best shown in FIGS. 13-14, base (74) has clip ends (76, 78), which provide a snug fit against the trailing and leading edges (19, 17) of fan blade (18). In one merely exemplary method of securing lower air fence (70) to fan blade, trailing edge clip end (76) is first engaged with trailing edge (19) of fan blade (18). Lower air fence (70) is then rotated toward leading edge (17) of fan blade (18) until leading edge clip end (78) deforms away from leading edge (17) to clear leading edge (17) of fan blade (18). Upon clearing leading edge (17) of fan blade (18), leading edge clip end (78) snaps back to securely grip leading edge (17) of fan blade (18). The resilience of lower air fence (70) and the relative, complementary cross-sections of lower air fence (70) and fan blade (18) may substantially prevent lower air fence (70) from sliding along the length of fan blade (18) during operation of fan (10). That is, the resilient bias of lower air fence (70) may increase friction between lower air fence (70) and fan blade (18) once lower air fence (70) has been installed on fan blade (18). In lieu of or in addition to such a "snap" fitting, lower air fence (70) may be secured to fan blade (18) using adhesive, mechanical fasteners, and/or any other suitable components, devices, or techniques.

In another version, each lower air fence (70) is substantially rigid, and base (74) is slid onto an end of fan blade (18). For instance, lower air fence (70) may be slid onto the hub end of fan blade (18) before fan blade (18) is coupled with hub (16). Alternatively, lower air fence (70) may be slid onto the free end of fan blade (18) before a winglet (20) is secured to the free end of fan blade (18). Regardless of whether lower air fence (70) is rigid or resilient, in some versions, removal of lower air fence (70) may be accomplished by sliding lower air fence (70) off either end of fan blade (18). A resilient lower air fence (70) may alternatively be "un-snapped" from fan blade (18) in some settings, such as by prying or peeling leading edge clip end (78) from leading edge (17) of fan blade (18) or in any other suitable fashion.

In the present example, the interior surface of base (74) has a profile that approximates the corresponding profile of fan blade (18), such that the base (74) is substantially continuously engaged with fan blade (18) across the transverse width of fan blade (18). Furthermore, vertical fin (72) has a profile that complements the profile of fan blade (18). It should be understood, however, that base (74) and fin (72) may each have any other desired profile. Such alternative profiles may have any suitable relationship with, or no relationship at all with, each other and/or the profile of fan blade (18). For instance, in the present example, fin (72) is configured such that its vertical height from base (74) is greater near leading edge clip end (78) than the vertical height of fin (72) from base (74) near trailing edge clip end (76). That is, fin (72) tapers down toward trailing edge (19) of fan blade (18). In some other versions, fin (72) is configured such that its vertical height from base (74) is greater near trailing edge clip end (76) than the vertical height of fin (72) from base (74) near leading edge clip end (78). In some such versions, fin (72) may taper down toward leading edge (17) of fan blade (18). Still other suitable configurations for fin (72) will be apparent to those of ordinary skill in the art in view of the teachings herein.

As shown, base (74) terminates at clip ends (76, 78), such that a gap is defined between clip ends (76, 78). In other versions, clip ends (76, 78) are omitted, and base (74) continuously defines an opening or aperture for a fan blade (18) to be slid into. Such an opening may have a cross-section that complements the cross-section of fan blade (18) or any other suitable cross-section.

As also shown, fin (72) extends downward from an outer lateral edge of base (74). In some versions, lower air fence (70) is installed on fan blade (18) such that fin (72) is positioned closer to hub (16), with base (74) extending toward winglet (20). Alternatively, fin (72) may be positioned such that it is positioned closer to winglet (20) when lower air fence (70) is installed on fan blade (18), with base (74) extending toward hub (16). In some other versions, fin (72) is positioned at the center of the width of base (74), or otherwise between outer edges of base (74). As yet another merely exemplary variation, fin (72) may extend at an angle. For instance, fin (72) may be angled such that it is closer to hub (16) near leading edge (17) yet closer to winglet (20) near trailing edge (19); or vice versa. Similarly, while fin (72) defines a substantially right angle with base (74) in the present example, it should be understood that fin (72) may alternatively define an acute or obtuse angle with base (74). Still other suitable ways in which fin (72) may be positioned and/or oriented will be apparent to those of ordinary skill in the art in view of the teachings herein.

In some versions of fan (10), only upper air fences (50) are provided; and lower air fences (70) are omitted entirely. In some other versions of fan (10), upper air fences (50) and lower air fences (70) are provided. In still other versions of fan (10), only lower air fences (70) are provided; and upper air fences (50) are omitted entirely. In versions where upper air fences (50) and lower air fences (70) are provided, it should be understood that upper and lower air fences (50, 70) may be kept separate, may be formed together, may be locked together after installation on fan blade (18), or have any other suitable relationship with each other.

Figure 15:
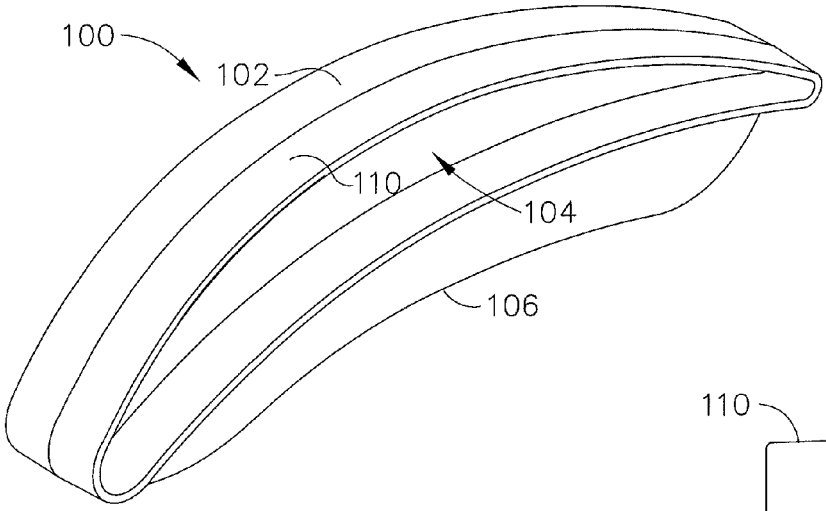
FIG. 15 depicts a perspective view of an exemplary alternative air fence.
Figure 16:
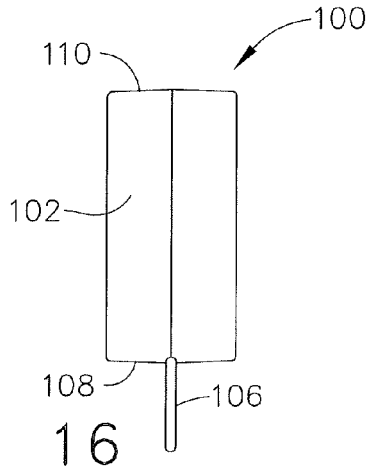
FIG. 16 depicts a front elevational view of the air fence of FIG. 15.
Figure 17:
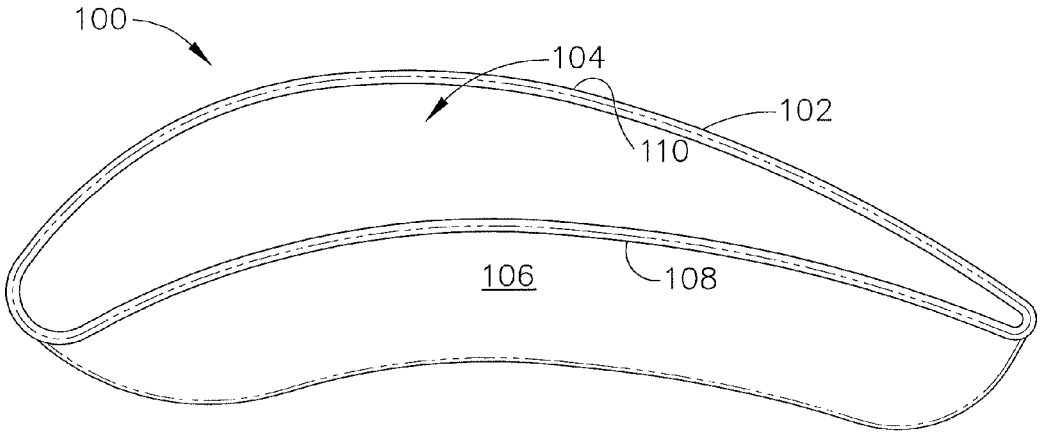
FIG. 17 depicts a side elevational view of the air fence of FIG. 15.

An exemplary alternative air fence (100) is shown in FIGS. 15-17. In this example, air fence (100) comprises a body (102) defining an opening (104) and having a downwardly extending fin (106). Body (102) is formed as a single, unitary piece in this example. Opening (104) is sized to complement the cross-sectional configuration of a fan blade (18). Accordingly, air fence (100) may be coupled with a fan blade (18) by inserting a free end of fan blade (18) through opening (104) and then sliding air fence (100) along the length of fan blade (18) until air fence (100) has reached a desired position along the length of fan blade (18). With air fence (100) so positioned, body (102) may completely surround the periphery of the fan blade (18) profile. It should be understood that air fence (100) may be slid onto the hub end of fan blade (18) before fan blade (18) is coupled with hub (16). Alternatively, air fence (100) may be slid onto the free end of fan blade (18) before a winglet (20) is secured to the free end of fan blade (18).

After fan blade (18) has been inserted through opening (104), the position of air fence (100) along the length of fan blade (18) may thereafter be substantially maintained in a variety of ways. For instance, body (102) may be configured such that the size of opening (104) is slightly smaller than the cross-sectional size of fan blade (18), such that the fit between air fence (100) and fan blade (18) is an interference fit. In addition or in the alternative, the interior of opening (104) may be at least partially lined with an elastomeric material and/or be provided with some other type of surface/feature that increases friction to facilitate gripping of fan blade (18) by air fence (100). As yet another merely illustrative variation, adhesives, clips, clamps, set screws, bolts, and/or any other suitable structures, devices, or techniques may be used to substantially maintain the position of air fence (100) along the length of fan blade (18).

While fin (106) extends downwardly from the lower surface (108) of body (102) in the present example, it should be understood that fin (106) may instead extend upwardly from the upper surface (110) of body (102), if desired. It should also be understood that, while fin (106) is positioned between the lateral edges of body (102) in the present example, fin (106) may instead be positioned at either lateral edge of body (102). Similarly, while fin (106) is oriented substantially perpendicularly relative to lower surface (108), fin (106) may instead be oriented obliquely relative to lower surface (108). Still other suitable configurations, positions, and orientations of fin (106) will be apparent to those of ordinary skill in the art in view of the teachings herein. Likewise, other suitable components, features, configurations, and operabilities of air fence (100) will be apparent to those of ordinary skill in the art in view of the teachings herein.

While fins (52, 72, 106) are shown as generally being formed by two sides and an edge, giving fins (52, 72, 106) a thin, flat, plate-like profile, it should be understood that fins (52, 72, 106) may have various other configurations, including but not limited to having rounded sides/faces, a wedge shape, etc.

It should be understood that, just like air fences (50, 70), air fence (100) may be coupled with any suitable fan blade, including but not limited to any fan blade as described in any of the references that are cited and incorporated by reference herein. By way of example only, air fence (70) may be used with any of the fan blades disclosed in U.S. Pub. No. 2010/0104461, entitled "Multi-Part Modular Airfoil Section and Method of Attachment between Parts," published Apr. 29, 2010, the disclosure of which is incorporated by reference herein. Other suitable ways in which air fences (50, 70, 100) may be used will be apparent to those of ordinary skill in the art in view of the teachings herein.

In the present example, each air fence (50, 70, 100) is provided as a removable accessory for a fan blade (18). However, air fences (50, 70, 100) may alternatively be provided as an integral, non-removable component of a fan blade (18). For instance, a fan blade (18) may be formed with one or more unitary air fences (50, 70, 100) extending therefrom.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. A fan, comprising:

(a) a rotatable hub;

(b) a plurality of fan blades, each fan blade having:

(i) an upper surface, (ii) a lower surface, (iii) a first end secured to the hub, (iv) a second end, (v) a leading edge, and (vi) a trailing edge; and (c) a plurality of air fences, wherein each air fence includes a fin and a fan blade engagement portion and is removably secured to a corresponding fan blade of the plurality of fan blades at a location between the first end and the second end of the corresponding fan blade and wherein the fan blade engagement portion defines an opening, wherein the corresponding fan blade is disposed through the opening.

2. The fan of claim 1, wherein the fin of at least some of the air fences extends downwardly relative to the lower surface of the corresponding fan blades.

3. The fan of claim 2, where each air fence further comprises a base, wherein the lower surface of each fan blade has a contour, wherein the base substantially complements the contour of the lower surface of the corresponding fan blade.

4. The fan of claim 1, wherein the fan blade engagement portion comprises a pair of clip ends.

5. The fan of claim 4, wherein the pair of clip ends comprises a leading edge clip end and a trailing edge clip end, wherein the leading edge clip end is configured to engage the leading edge of the corresponding fan blade, wherein the trailing edge clip end is configured to engage the trailing edge of the corresponding fan blade.

6. The fan of claim 5, wherein each air fence defines a gap spanning between the leading edge clip end and the trailing edge clip end.

7. The fan of claim 6, wherein each air fence is formed of a resilient material, allowing the size of the gap to be changed by bending the air fence.

8. The fan of claim 1, wherein the fin tapers toward the trailing edge of the corresponding fan blade.

9. The fan of claim 1, wherein the fan blades extend along a horizontal plane and wherein the fins extend substantially vertically.

10. The fan of claim 1, wherein each fan blade has a profile periphery defined by the corresponding upper surface, lower surface, leading edge, and trailing edge, wherein the fan blade engagement portion completely surrounds the profile periphery of the corresponding fan blade.

11. The fan of claim 1, wherein each air fence is coupled with the corresponding fan blade by a snap fitting.

12. The fan of claim 1, wherein each air fence is configured to resiliently grip the corresponding fan blade.

13. The fan of claim 1, wherein each air fence comprises:

(i) a body having a front region associated with the leading edge of the corresponding fan blade, a rear region associated with the trailing edge of the corresponding fan blade, and a pair of lateral edges extending between the front and rear regions, and (ii) the fin extending from one of the lateral edges.

14. The fan of claim 1, wherein each fan blade defines an airfoil shape.

15. The fan of claim 14, wherein each air fence is configured to complement the airfoil shape of the corresponding fan blade.

16. The fan of claim 1, wherein each fan blade has more than one secured air fence of the plurality of air fences.

17. The fan of claim 1, further including an adhesive for securing at least one air fence to the corresponding fan blade.

18. An air fence, comprising:

(a) a body, the body comprising:

(i) an upper surface, wherein the upper surface is configured to complement a lower surface of an airfoil-shaped fan blade, (ii) a lower surface, (iii) a leading edge engagement portion configured to engage a leading edge of the airfoil-shaped fan blade, and (iv) a trailing edge engagement portion configured to engage a trailing edge of the airfoil-shaped fan blade; and (b) a fin extending downwardly from the lower surface of the body.

19. The air fence of claim 18, wherein the body comprises an opening having a first open end and a second open end.

20. An air fence, comprising:

(a) a body, the body comprising an upper surface and a lower surface, wherein the body defines an opening having a first open end and a second open end, said opening shaped to complement an airfoil shape of a fan blade for disposition of the fan blade through the first open end and the second open end of the opening; and (b) a fin extending downwardly from the lower surface of the body.

21. A fan, comprising:

(a) a rotatable hub;

(b) a plurality of fan blades, each fan blade having:

(i) an upper surface, (ii) a lower surface, (iii) a first end secured to the hub, (iv) a second end, (v) a leading edge, (vi) a trailing edge; and (c) a plurality of air fences, wherein each air fence is secured to a corresponding fan blade of the plurality of fan blades at a location between the first end and the second end of the corresponding fan blade;

wherein each air fence comprises a fin and a fan blade engagement portion;

wherein the fan blade engagement portion defines an opening;

wherein the corresponding fan blade is disposed through the opening.

22. The fan of claim 21, wherein each fan blade has a profile periphery defined by the corresponding upper surface, lower surface, leading edge, and trailing edge.

* * * * *